US012193539B1

(12) United States Patent
Jamuna

(10) Patent No.: US 12,193,539 B1
(45) Date of Patent: Jan. 14, 2025

(54) SHOE ASSIST SYSTEM

(71) Applicant: Seema Jamuna, Boynton Beach, FL (US)

(72) Inventor: Seema Jamuna, Boynton Beach, FL (US)

( * ) Notice: Subject to any disclaimer, the term of this patent is extended or adjusted under 35 U.S.C. 154(b) by 88 days.

(21) Appl. No.: 18/083,168

(22) Filed: Dec. 16, 2022

(51) Int. Cl.
*A43B 13/18* (2006.01)
*A43B 7/1467* (2022.01)
*A43B 17/02* (2006.01)

(52) U.S. Cl.
CPC ..... *A43B 13/18* (2013.01); *A43B 7/1467* (2022.01); *A43B 17/02* (2013.01); *A43B 13/181* (2013.01); *A43B 13/183* (2013.01); *A43B 13/185* (2013.01)

(58) Field of Classification Search
CPC ..... A43B 13/18; A43B 13/181; A43B 13/183; A43B 13/185; A43B 7/1467; A43B 17/02
USPC ..... 36/27
See application file for complete search history.

(56) References Cited

U.S. PATENT DOCUMENTS 741,012 A * 10/1903 Corey ..... A43B 13/181 36/3 R
4,296,557 A * 10/1981 Pajevic ..... A43B 13/182 36/7.8
4,322,893 A * 4/1982 Halvorsen ..... A43B 13/182 36/43
5,572,805 A * 11/1996 Giese ..... A43B 13/188 36/31
5,706,589 A * 1/1998 Marc ..... A43B 13/182 36/27
6,578,291 B2 * 6/2003 Hirsch ..... A43B 5/00 36/137
7,490,416 B2 * 2/2009 Townsend ..... A43B 7/144 36/154
7,926,205 B2 * 4/2011 Åmark ..... A43C 15/14 36/134
8,141,272 B2 * 3/2012 Hay ..... A43B 13/18 36/35 R
8,872,362 B2 * 10/2014 Lee ..... A43B 13/181 290/1 R
9,370,221 B1 * 6/2016 Hsu ..... A43B 1/0054
9,480,302 B2 * 11/2016 Freschi ..... A63B 25/10
9,687,381 B2 6/2017 Ward
9,848,674 B2 * 12/2017 Smith ..... A43C 11/00
9,961,960 B2 * 5/2018 Desmarais ..... A43B 13/20
10,039,342 B2 * 8/2018 Reinhardt ..... A43B 7/144
10,448,702 B2 * 10/2019 Farris ..... A43B 13/141
10,709,201 B2 * 7/2020 Auyang ..... A43B 23/0235
10,736,375 B2 8/2020 Yao
10,743,613 B2 * 8/2020 Farris ..... A43B 13/189
10,959,484 B1 * 3/2021 Tarlton ..... A63B 24/0062
11,445,784 B2 * 9/2022 Brown ..... A43B 13/16
(Continued)

*Primary Examiner* — Timothy K Trieu
*Assistant Examiner* — Dakota Marin
(74) *Attorney, Agent, or Firm* — Sanchelima & Associates, P.A.; Christian Sanchelima; Jesus Sanchelima

(57) ABSTRACT

A shoe assist system including an insole assembly, a sliding assembly, and a spring assembly. The insole assembly includes an insole. The insole can be inserted in the shoe to provide support to the user. The insole has an opening on a central portion thereof. The sliding assembly includes a slidable element. The slidable element slides back and forth in the opening of the insole. The spring assembly includes at least one spring inserted in the insole. The spring provides cushioning to the insole while walking or running.

4 Claims, 3 Drawing Sheets

(56) References Cited

U.S. PATENT DOCUMENTS

2002/0133976 A1* 9/2002 Crutcher ..... A43B 13/182 36/27
2003/0033731 A1* 2/2003 Sizemore ..... A43B 13/182 36/27
2004/0154191 A1* 8/2004 Park ..... A43B 13/182 36/27
2005/0183292 A1* 8/2005 DiBenedetto ..... A43B 3/0042 36/132
2005/0193589 A1* 9/2005 Bann ..... A43B 13/187 36/28
2006/0174515 A1* 8/2006 Wilkinson ..... A43B 21/32 36/27
2007/0209233 A1* 9/2007 Kim ..... A43B 7/082 36/27
2008/0086916 A1* 4/2008 Ellis ..... A43B 13/187 36/103
2008/0229623 A1* 9/2008 Ferretti ..... A43B 7/082 36/3 R
2008/0271339 A1* 11/2008 Fischer ..... A43B 17/02 36/44
2012/0017467 A1* 1/2012 Whitney ..... A43B 13/20 36/31
2012/0048663 A1* 3/2012 McDonnell ..... A43B 13/189 188/266
2014/0000125 A1* 1/2014 Butler ..... A43B 13/181 36/43
2014/0109440 A1* 4/2014 McDowell ..... A43B 13/16 36/103
2014/0130269 A1* 5/2014 Dabah ..... A43B 13/181 12/142 R
2015/0157091 A1* 6/2015 Hsu ..... A43B 13/40 36/44
2018/0020771 A1* 1/2018 Lo ..... A43B 13/203 36/29
2019/0133252 A1* 5/2019 Jeong ..... A43B 13/181
2020/0163407 A1* 5/2020 Lim ..... A43B 13/181
2020/0170335 A1* 6/2020 Horvath ..... A43B 3/0047

* cited by examiner

SHOE ASSIST SYSTEM

BACKGROUND OF THE INVENTION

1. Field of the Invention

The present invention relates to a shoe assist system and, more particularly, to a shoe assist system that provides support and relief through a soft insert having springs and a sliding element thereinto.

2. Description of the Related Art

Several designs for shoe soles have been designed in the past. None of them, however, include a sliding element to provide support to the feet while walking or standing on tiptoes.

Applicant believes that a related reference corresponds to U.S. Pat. No. 10,736,375 issued for a shoe sole with zones filled with multiple foaming material and an interchangeable compact MagLev module. Applicant believes that another related reference corresponds to U.S. Pat. No. 9,687,381 issued for a modular footbed comprised of a forefoot portion, a heel portion, a bridge, and an arch support which can be fashioned to place the knee in dynamic alignment with the femoral head of the femur and the ankle. None of these references, however, teach of a show insert comprising a resilient heel member, and a rocking assist system comprising an arch insert having a sliding element and spring rebound member.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide a shoe assist system that includes a sole made of a soft and reformable material to provide conform to the user.

It is another object of this invention to provide a shoe assist system that includes springs to provide impact absorption.

It is another object of this invention to provide a shoe assist system that includes a sliding element in a central portion to support the feet of the user when standing on toe tips.

It is still another object of the present invention to provide a shoe assist system that is adaptable to different sizes.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
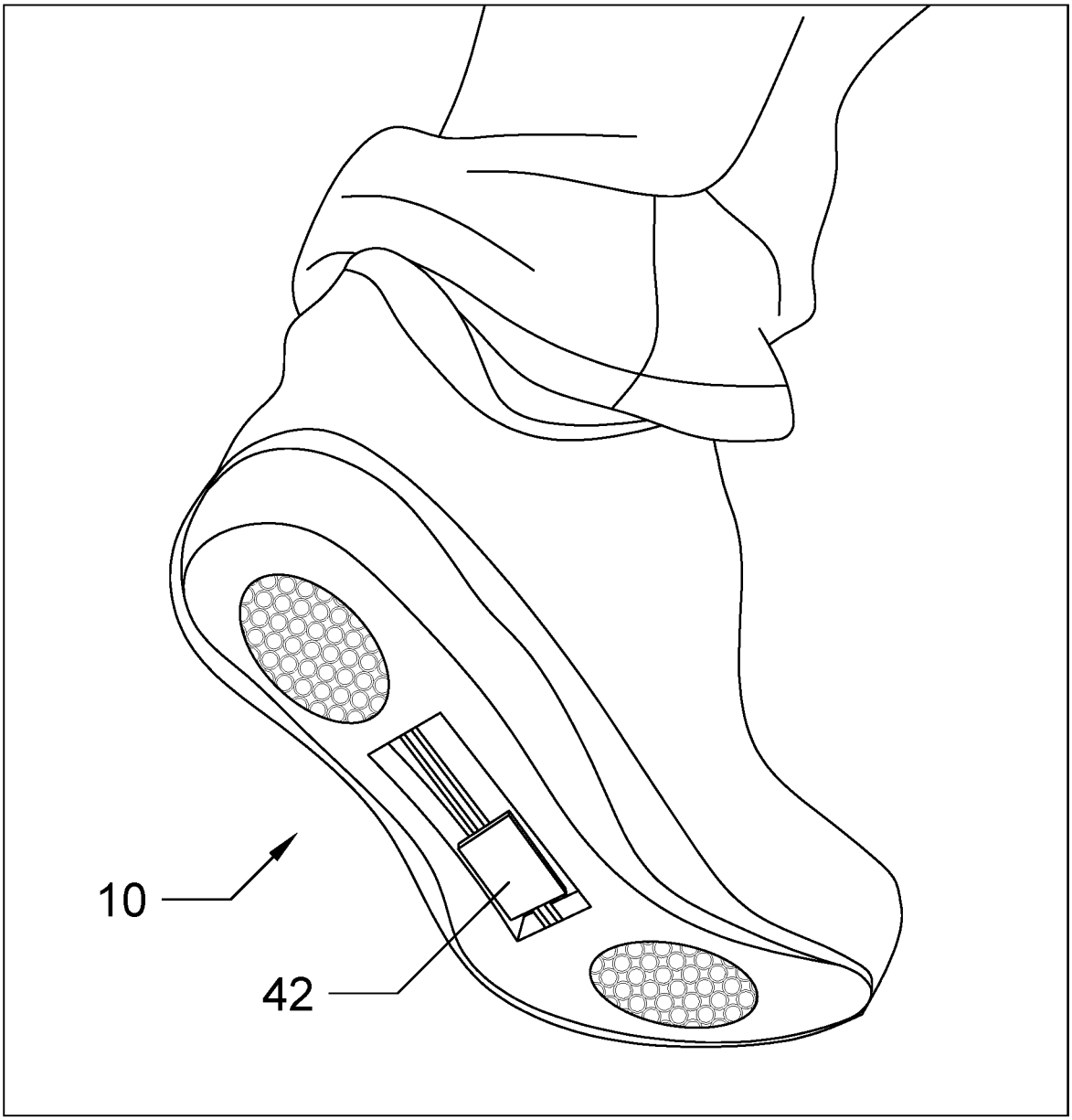
FIG. 1 represents an operational see-through view of the present invention 10 having the slidable element 42 in a front configuration.

Referring now to the drawings, where the present invention is generally referred to with numeral 10, it can be observed that it basically includes insole assembly 20, a sliding assembly 40 and a spring assembly 60. It should be understood there are modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

The insole assembly 20 may have an insole 22. The insole 22 may have a bottom portion 26. The insole 22 may have an elongated curved shape. The insole 22 may conform with the shape of a shoe's insole. The insole 22 may be made of viscoelastic polyurethane, acrylic, polypropylene, cork, foam, ethylene-vinyl acetate, or any other suitable material. The insole 22 may provide protection and relieve pressure by cushioning and padding a painful or injured area. It also may be suitable for the insole 22 to have relief to correct posture or define the foot arch of wearer. In one embodiment the insole 22 may have cutting lines so it can be adapted to any size of shoe. The insole 22 may be inserted into the shoe to provide support to the wearer.

The bottom portion 26 of the insole 22 may be made of viscoelastic polyurethane, acrylic, polypropylene, cork, foam, ethylene-vinyl acetate, or any other suitable material. The bottom portion 26 may be beneath the insole 22. The bottom portion 26 may conform with the shape of the insole 22. The bottom portion 26 may have a greater height than a height of the insole 22. Thus, the bottom portion 26 may be thicker than the insole 22. The bottom portion 26 may be suitable to receive the sliding assembly 40 and the spring assembly 60. The bottommost end of the bottom portion 26 may be in abutting contact with the shoe's sole.

Figure 2:
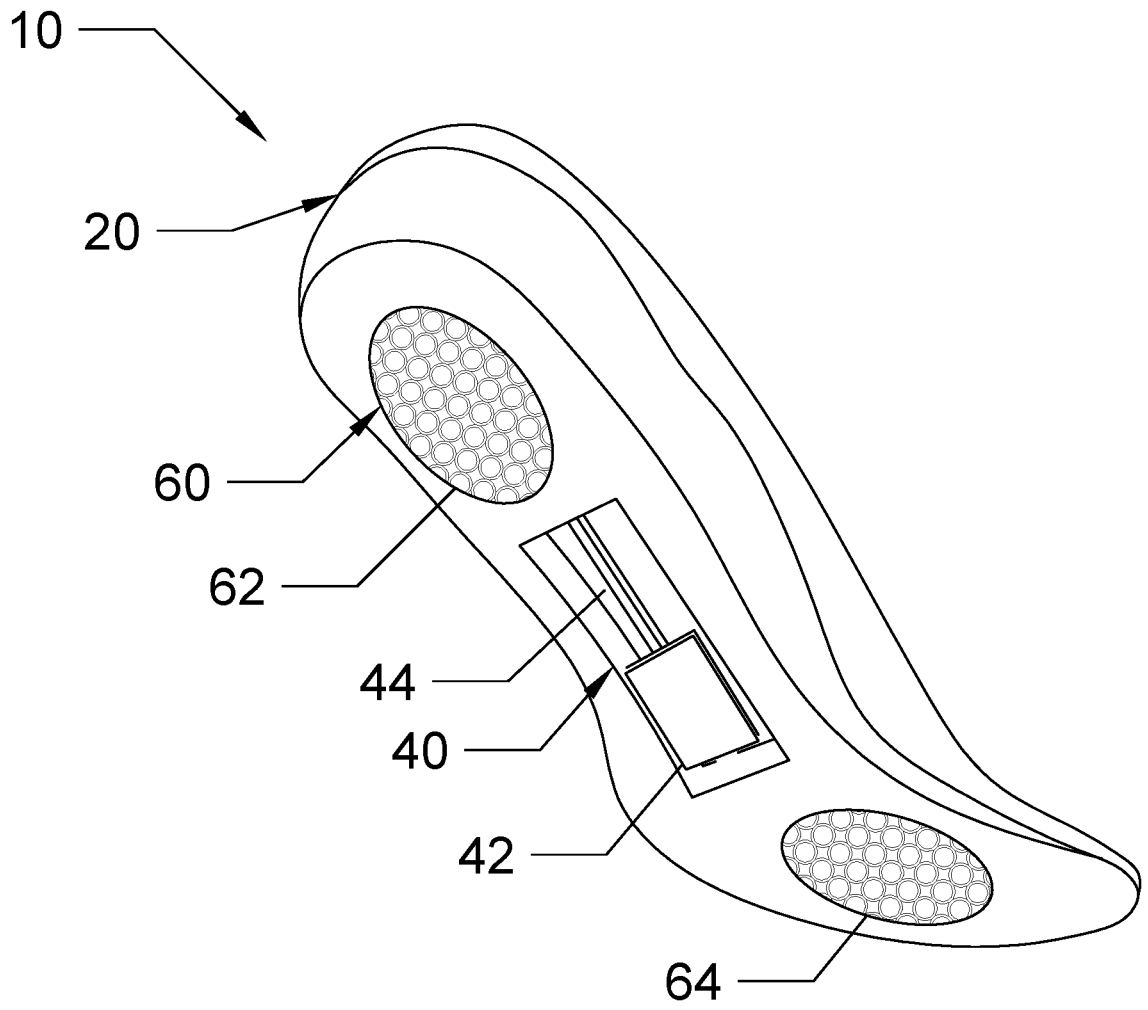
FIG. 2 shows a bottom perspective view of the present invention 10. The present invention includes an insole assembly 20, a sliding assembly 40 and a spring assembly 60.

Referring now to FIG. 2 it can be observed that the sliding assembly 40 may include a slidable element 42, a channel 44 and an opening 46. The slidable element 42 may preferably have a rectangular shape. It also may be suitable for the slidable element 42 to have a rectangular shape, an oval shape, or any other suitable shape. The slidable element 42 may move back and forth through channel 44, due to gravity. In a preferred embodiment the slidable element 42 may move forth when a rear portion of the sole assembly 20 is elevated with respect to a front portion of the sole assembly, as best illustrated in FIG. 1. The slidable element 42 may move back when the front portion of the sole assembly is elevated with respect to the rear portion of the sole assembly 20. The slidable element 42 may provide support while walking or running by moving back and forth. The slidable element 42 may be located on a central portion of the sole 22. As best shown in FIG. 2 the slidable element 42 may be attached to the channel 44. The slidable element 42 may be inside of the opening 46.

Figure 3:
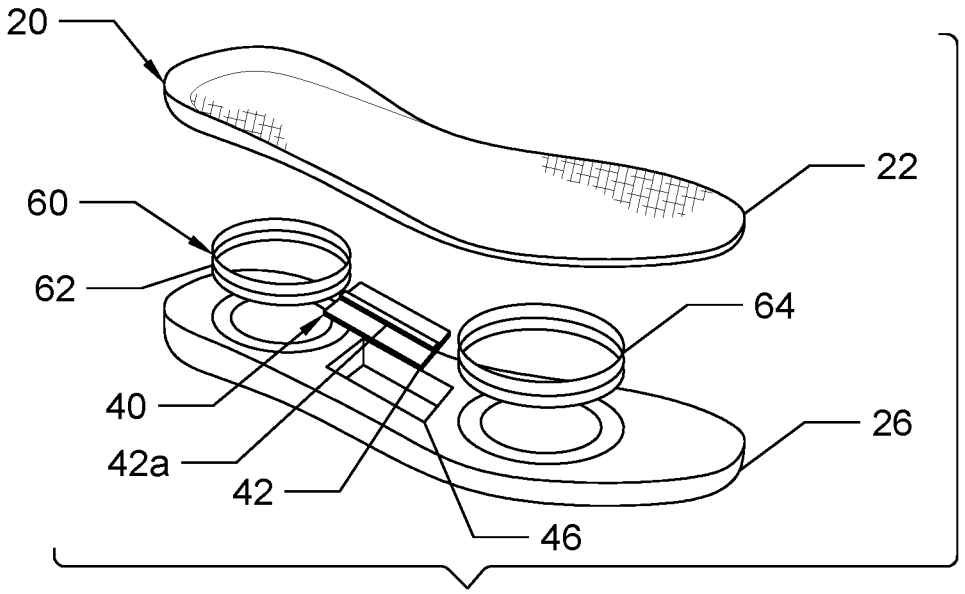
FIG. 3 illustrates an exploded view of the present invention 10 showing the springs 62 and 64.
Figure 4:
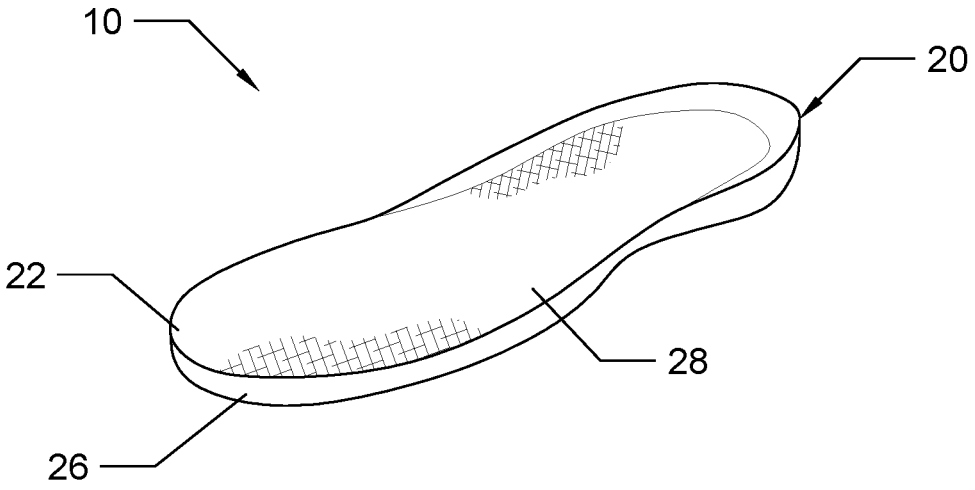
FIG. 4 is a representation of an isometric view of the present invention 10.

The opening 46 may be located on a central portion of the insole assembly 20. In a preferred embodiment the opening 46 may transversely go through the bottom portion 26. It also may be suitable for the opening 46 to partially go through the insole 22. The channel 44 may be attached to a central portion of the insole 22. As best illustrated in FIG. 3 the slidable element 42 may have a protruding element 42*a*. The protruding element 42*a* may be coupled to the channel 44. The protruding element 42 may allow sliding of the slidable element 42 through the channel 44.

Referring now to FIG. 2 it can be observed that the spring assembly 60 may include a first spring 62 and a second spring 64. The first spring 62 is located on a rear portion of the bottom portion 26. The first spring 62 may be inserted into the bottom portion 26. The uppermost end of the first spring 62 may be fixed to a rear portion of the insole 22. The second spring 64 may be inserted into the bottom portion 26. The second spring 64 may be located on a front portion of the bottom portion 26. A bottommost end of the first spring 62 and a bottommost end of the second spring 64 may be covered by a plastic element illustrated in FIG. 2. The first spring 62 and the second spring 64 may provide cushioning to the present invention. The first spring 62 and the second spring 64 may be made of metal, plastic, or any other suitable material. The first spring 62 and the second spring 62 may have a circular shape. It also may be suitable for the first spring 62 and the second spring 64 to have an oval shape, or any other suitable shape. Although only the first spring 62 and the second spring 63 are mentioned it should be understood that additional springs can be used. In an alternative the first spring 62 and the second spring 64 may consist of a plurality of springs aligned in a circular configuration.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A shoe assist system, comprising:

an insole assembly, wherein said insole assembly includes an insole, said insole is insertable in a shoe, said insole has a bottom portion with an rectangular opening centrally located; wherein the bottom portion contours to a periphery of the insole: said insole features a channel on a bottom surface of the insole so that when the insole is placed upon the bottom portion the channel is circumscribed within the rectangular central opening: wherein the channel extends along a length of the rectangular central opening;

a sliding assembly, wherein said sliding assembly includes a rectangular slidable element that is shaped to fit said rectangular opening; wherein said slidable element has a protruding element extending along a length of the slidable element; wherein the protruding element is attached to said channel and is configured to slide back and forth along said channel within the rectangular central opening; wherein the slidable element is configured to slide backwards when a front portion of the bottom portion is elevated with respect to a rear portion of the bottom portion due to gravity, and slide forward when the rear portion of the bottom portion is elevated with respect to the front portion of the bottom portion also due to gravity, wherein said slidable element attached to the channel defines an arch inserting; and a spring assembly including a first spring and a second spring; wherein said first spring is inserted into the rear portion of said bottom portion; wherein said second spring is inserted into the front portion of said bottom portion; wherein said rectangular central opening is located between the first and the second springs.

2. The shoe assist system set forth in claim 1, wherein an uppermost end of each of said springs is fixed to said insole and said springs are inserted into said bottom portion.

3. The shoe assist system set forth in claim 1, wherein said bottom portion is thicker than said insole.

4. A shoe assist system, consisting of:

an insole assembly, wherein said insole assembly includes an insole, said insole is insertable in a shoe, said insole has a bottom portion with an rectangular opening centrally located; wherein said bottom portion is thicker than said insole; wherein the bottom portion contours to a periphery of the insole; said insole features a channel on a bottom surface of the insole so that when the insole is placed upon the bottom portion the channel is circumscribed within the rectangular central opening; wherein the channel extends along a length of the rectangular central opening;

a sliding assembly, wherein said sliding assembly includes a rectangular slidable element that is shaped to fit said rectangular opening; wherein said slidable element has a protruding element extending along a length of the slidable element; wherein the protruding element is attached to said channel and is configured to slide back and forth along said channel within the rectangular central opening; wherein said slidable element attached to the channel defines an arch inserting;

a spring assembly including a first spring and a second spring; wherein said first spring is inserted into a rear portion of said bottom portion; wherein said second spring is inserted into a front portion of said bottom portion; wherein said rectangular central opening is located between the first and the second springs;

wherein said slidable element moves back when said front portion is elevated with respect to said rear portion due to gravity; wherein said slidable element moves forth when said rear portion is elevated relative to said front portion also due to gravity.

* * * * *